United States Patent [19]

Masumoto et al.

[11] Patent Number: 4,614,221

[45] Date of Patent: Sep. 30, 1986

[54] METHOD OF MANUFACTURING THIN METAL WIRE

[75] Inventors: Tsuyoshi Masumoto, No. 8-22, Kamisugi 3-chome, Sendai-shi, Miyagi; Tatsuo Hamashima, Osaka; Michiaki Hagiwara, Kyoto, all of Japan

[73] Assignees: Unitika Ltd.; Tsuyoshi Masumoto, both of Japan

[21] Appl. No.: 426,443

[22] Filed: Sep. 29, 1982

[30] Foreign Application Priority Data

Sep. 29, 1981 [JP] Japan ..... 56-154065
Jan. 8, 1982 [JP] Japan ..... 57-1613

[51] Int. Cl.[4] ..... B22D 11/00
[52] U.S. Cl. ..... 164/462; 164/423
[58] Field of Search ..... 164/462, 423

[56] References Cited

U.S. PATENT DOCUMENTS

| | | | |
|---|---|---|---|
| 2,879,566 | 3/1959 | Pond | 164/462 |
| 3,347,959 | 10/1967 | Engelke et al. | 164/462 |
| 3,461,943 | 8/1969 | Schile | 164/462 X |
| 3,645,657 | 2/1972 | Otstot et al. | 164/462 X |
| 3,658,979 | 4/1972 | Dunn et al. | 164/462 X |
| 3,715,419 | 2/1973 | Privott, Jr. et al. | 164/462 X |
| 3,845,805 | 11/1974 | Kavesh | 164/462 |
| 3,856,513 | 12/1974 | Chen et al. | 164/462 X |
| 4,303,119 | 12/1981 | Jarrige et al. | 164/462 |
| 4,318,440 | 3/1982 | Reiniche | 164/423 X |

FOREIGN PATENT DOCUMENTS

| | | | |
|---|---|---|---|
| 5564948 | 10/1978 | Japan | 164/463 |
| 75253 | 5/1982 | Japan | 164/462 |

OTHER PUBLICATIONS

Oonaka (Ohnaka), Production of Pd-Cu-Si Amorphous Wires by Melt Spinning Method Using Rotating Water, Scripta Metallurgica, vol. 15, #3, pp. 293-296, Mar. 1981.

G. Tammann, "The Preparation of Thin Wires by Solidification of Liquid Metal Jets", 1935, pp. 1-5.

*Primary Examiner*—Nicholas P. Godici
*Assistant Examiner*—Christopher L. McKee
*Attorney, Agent, or Firm*—Sughrue, Mion, Zinn, Macpeak, and Seas

[57] ABSTRACT

A method of producing a thin metal wire having a circular cross section is disclosed. The wire is produced by providing a molten metal within an extruding device having a nozzle therein. A strip of liquid coolant in motion at a speed of 200 m/min or more is then provided. The molten metal is extruded into the strip of liquid coolant in order to cool and solidify the metal and form the thin metal wire. A high quality thin metal wire is obtained by precisely adjusting the speed of the strip of liquid coolant relative to the speed of the extruded molten metal as well as the angle at which the molten metal is extruded into the liquid coolant strip. The method is capable of economically and continuously producing a high quality thin metal wire on a commercial scale. The method is effective in directly producing a thin metal wire having an amorphous, a nonequilibrium crystalline, or microcrystalline structure.

12 Claims, 3 Drawing Figures

METHOD OF MANUFACTURING THIN METAL WIRE

FIELD OF THE INVENTION

This invention relates to a method for continuous production of a thin metal wire of high quality having a circular cross section. The wire can be produced in an economical manner directly from molten metal on a commercial scale. More particularly, this invention relates to a novel method for the manufacture of a thin metal wire which comprises extruding a flow of molten metal through a spinning nozzle and immediately forwarding the flow of molten metal into contact with a strip of liquid coolant thereby quenching and solidifying the flow of molten metal.

BACKGROUND OF THE INVENTION

Thin metal wire can be inexpensively produced by making the wire directly from molten metal. Thin metal wire produced in this manner is characterized by retaining the physical properties peculiar to the metal used. Furthermore, such wires have utility with respect to electric and electronic parts, composite materials, and textile materials. Furthermore, such wires are capable of withstanding high tension relative to their small thickness. It is a highly promising material suitable for various industrial applications. If a thin metal wire obtained by superquenching has a circular cross section and an amorphous structure, a nonequilibrium crystalline structure, or a microcrystalline structure, it acquires many excellent chemical, electromagnetic, and physical properties. Therefore, such a wire will find acceptance for actual use in various fields.

The so-called liquid quenching method produces a uniform, continuous thin metal wire by extruding molten metal through a spinning nozzle. Before the extruded flow of molten metal is cut by its own weight or broken by vibration, the flow of molten metal is brought into contact with the surface of a solid roll in rapid rotary motion thereby quenching and solidifying the flow of molten metal. Various studies have been made and suggestions offered relating to this method. Since the cooling rate in this method is as high as about $10^{5}$° C./sec, this method has been found to be highly effective in stably producing a ribbon of amorphous metal, nonequilibrium crystalline metal, or microcrystalline metal. Unfortunately, this method is only capable of producing thin metal wire of flattened cross section and such a product is only suitable for special uses. A thin metal wire of a circular cross section cannot be produced by this method.

Japanese Patent Application (OPI) No. 135820/74 (the term "OPI" as used herein refers to a "published unexamined Japanese patent application") (corresponding to U.S. Pat. No. 3,845,805) discloses a method which can be used for producing a thin metal wire having a circular section. When the method is used for this purpose, it involves passing a flow of molten metal through a quenching zone formed of a liquid medium so as to solidify the flow of molten metal. The essential requirements for this method are (1) that, in the quenching zone, the flow of molten metal discharged through the spinning nozzle and the flow of the liquid cooling medium should run parallel and (2) that, in the quenching zone, the flow of molten metal discharged through the spinning nozzle and the flow of the liquid cooling medium should run at the same speed. Since the flow of the liquid cooling medium relies for its speed upon the gravitational attraction acting upon the medium itself, the highest possible speed is on the order of only 180 m/min and can never be increased beyond this level. It would be quite difficult to further increase the speed of quenching and solidification by this method.

In producing a thin metal wire of high quality having an amorphous structure, a nonequilibrium crystalline structure or a microcrystalline structure, it is important that the flow of molten metal be quenched and solidified at a speed of at least $10^4$ °C./sec. As described above, the flow of molten metal and that of the liquid cooling medium run parallel to each other and at the same speed within the quenching zone and this speed itself is slow. The cooling speed is too low to produce a thin metal wire of high quality having a circular cross section. Moreover, since the speed of the liquid cooling medium is slow and the kinetic energy (speed × mass) of the medium is consequently small, the flow of the liquid cooling medium and its surface are disturbed by colliding with the flow of molten metal discharged through the spinning nozzle and by the boiling, vaporization, and convection of the liquid cooling medium. Thus, a thin metal wire of high quality having an amorphous structure, a nonequilibrium crystalline structure, or a microcrystalline structure cannot be obtained in a diameter with a satisfactory uniform circular cross section and without size irregularity in the longitudinal direction.

Japanese Patent Application (OPI) No. 69430/76 discloses a method which cools and solidifies the flow of molten metal by contacting it with a coolant to produce a continuous metal filament having a uniform circular cross section. The angle of contact between the flow of the coolant and that of molten metal discharged through a spinning nozzle is limited to within 20°. The flow speed, V (m/min), of the coolant is limited within the range of $V_m < V \leqq 5/2V_m$ [wherein $V_m$ denotes the speed (m/min) of the flow of molten metal discharged through the spinning nozzle]. This method is capable of appreciably reducing the impact of collision of the flow of molten metal with that of the coolant. However, the method is not capable of producing a very high cooling speed, because the flow of the molten metal and that of the coolant still run substantially parallel. Even though efforts have been made to alleviate the collision, this method cannot produce a metal filament of high quality having a satisfactory uniform circular cross section. The cooling rate involved in this method is still not sufficient for the purpose of cooling a metal which is capable of forming an amorphous structure or a nonequilibrium crystalline structure and which, therefore, calls for a high cooling rate. By this method, therefore, it is difficult to obtain a metal filament of high quality processing excellent chemical, electromagnetic, and physical properties and having an amorphous structure or a nonequilibrium crystalline structure.

Japanese Patent Application (OPI) No. 64948/80 discloses the so-called submerged rotary spinning method. This method cools and solidifies a flow of molten metal extruded through a spinning nozzle by leading the flow of molten metal into a rotary cylinder containing a coolant. Although the coolant rotates at a very high speed, the rotating body of this coolant is stabilized by the action of the centrifugal force acting thereon. Because of the high cooling rate, this method has been found to be a desirable way of producing, in a limited quantity, a metal filament of high quality having a circular cross section. In accordance with this method, since the centrifugal force is used to keep the coolant in the form of a layer within the rotary cylinder and also since the cooled and solidified metal filament is continuously wound up in a pile on the inner wall surface of the rotary cylinder, the depth of the layer of coolant, the filament winding speed, the temperature of the coolant, etc., are varied gradually with time. Therefore, for continuous voluminous production of a metal filament of high quality there may be many unsolved problems with respect to this matter. Since the size, particularly the width, of the rotary cylinder is limited, the operation is inevitably batchwise . Continuous production of the metal filament on a commercial scale, therefore, is extremely difficult. Moreover, since this method requires the use of one rotary cylinder as a rule for each spinning nozzle in use, the cost of equipment and the cost of power for the actual production are prohibitively high.

SUMMARY OF THE INVENTION

An object of this invention is to provide a method for continuously and economically producing, on a commercial scale, a thin metal wire of high quality having a circular cross section directly from the molten mass of a pure metal, a metal containing a trace of impurities, an alloy of at least two metals, particularly, a metal having an ability to form an amorphous structure, or a metal having an ability to form a non-equilibrium crystalline structure without relying on any special method for the stabilization of the extruded flow of molten metal.

As a result of continued study the present inventors have found that above objects can be obtained by a thin metal wire of high quality having a circular cross section obtained by extruding a flow of molten metal under specific conditions into a strip of liquid coolant in motion at a speed of at least 200 m/min thereby cooling and solidifying the flow of molten metal.

The present invention is a method for the manufacture of a thin metal wire of high quality having a circular cross section. The method is characterized by extruding a flow of molten metal into a strip of liquid coolant in motion at a speed of at least 200 m/min under the conditions satisfying the following formulae (I) and (II), thereby cooling and solidifying the flow of molten metal:

$$V_W > V_J \quad \text{(I)}$$

$$\theta \geqq 30 \quad \text{(II)}$$

wherein, $V_W$ denotes the speed (m/min) of the strip of liquid coolant, $V_J$ denotes the speed (m/min) of the flow of molten metal extruded through a spinning nozzle, and $\theta$ denotes the angle (°) formed between the flow of the strip of liquid coolant and the flow of molten metal discharged through the spinning nozzle.

The thin metal wire manufactured by this invention and possessed of an amorphous, nonequilibrium crystalline, or microcrystalline structure is superior to conventional metal wire of a crystalline structure in many chemical, electromagnetic, and physical properties. Accordingly, the wire of the present invention could be very useful in connection with numerous products such as electric and electronic parts, electromagnetic parts, composite materials, and textile materials.

DETAILED DESCRIPTION OF THE INVENTION

Figure 1:
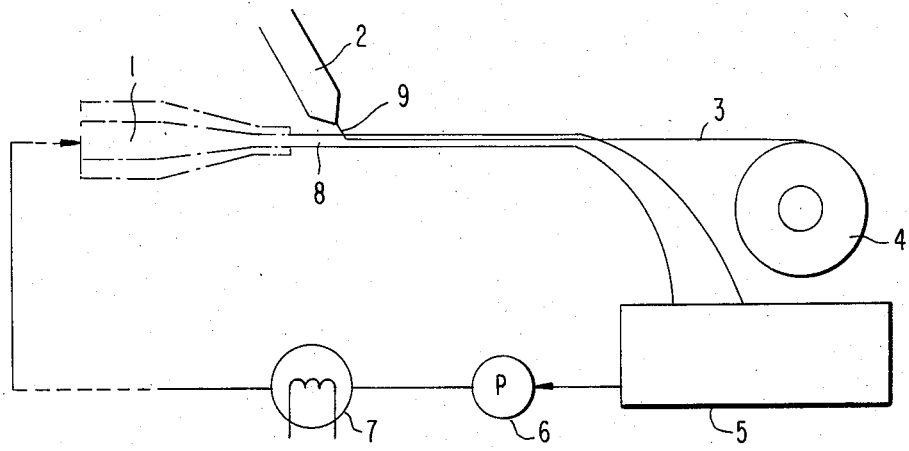
FIG. 1 is a schematic diagram illustrating the operation of the present invention.

The metal to be used for this invention may be a pure metal, a metal containing trace impurities, an alloy of at least two metals, or another type of metal. It is particularly desirable to adopt a metal which acquires excellent properties when it is transformed from a molten state to a solidified state by quenching. For example, it is preferable to use a metal which forms an amorphous structure or nonequilibrium crystalline structure as a result of the transformation. Specific examples of metals capable of forming an amorphous structure are disclosed and described in: Science, Vol. 8, pp. 62–72, 1978, *Report of Japan Metallography Society,* Vol. 15, No. 3, pp. 151–206, 1976, and Metals, pp. 73–78, Dec. 1, 1971 issue, Japanese Patent Application (OPI) No. 91014/74 (corresponding to U.S. Pat. No. 3,856,513 incorporated herein by reference to disclose such metals), Japanese Patent Application (OPI) Nos. 101215/75, 135820/74 (corresponding to U.S. Pat. No. 3,845,805 incorporated herein by reference to disclose such metals), 3312/76, 4017/76, 4018/76, 4019/76, 65012/76, 73920/76, 73923/76, 78705/76, 79612/76, 5620/77, 114421/77 and 99035/79.

The Fe-Si-B system, Fe-P-C system, Fe-Cr-Si-B system, Fe-Cr-P-C system, Fe-Me(Mo, V, W)-P-C system, Fe-P-B system, Fe-Cr-P-B system, Fe-Me(Ni, Co, Ta, Nb, W)-Si-B system, Co-Si-B system, Co-Me(Fe, Ni, Nb, Ta, Cr)-Si-B system, Ni-Si-B system, and other similar metals are typical alloys which have an excellent ability to form an amorphous structure. Similar useful and desirable metals can be selected from a very large number of metal-semimetal and metal-metal combinations. Accordingly, it is possible to formulate alloys having outstanding properties never attained by conventional crystalline metals by making the most of the characteristics of the alloy compositions described above. Specific examples of metals capable of forming a nonequilibrium crystalline structure include Fe-Cr-C type alloys and the Fe-Al-C type alloys disclosed in Japanese Patent Application (OPI) No. 3651/81, *Iron and Steel,* No. 3, pp. 382–389, 66th Year (1980), *Journal of Japan Metallography Society,* Vol. 44, No. 3, pp. 245–254, 1980, TRANSACTIONS OF THE JAPAN INSTITUTE OF METALS, Vol. 20, No. 8, pp. 468–471, August 1979, and *Collection of Summaries of General Lectures at Autumn General Meeting of Japan Metallography Society,* pp. 350–351, October 1979, and the Mn-Al-C type alloys, Fe-Cr-Al type alloys, Fe-Mn-Al-C type alloys, etc., disclosed in *Collection of Summaries of General Lectures at Autumn General Meeting of Japan Metallography Society,* pp. 423–425, November 1981.

The words "strip of liquid coolant" as used in this disclosure means a layer of liquid coolant in which the liquid coolant is moving or flowing in the form of a strip at a speed of at least 200 m/min, preferably 300 to 800 m/min, more preferably 400 to 650 m/min. If the speed is less than 200 m/min, the cooling speed is not sufficient and the liquid coolant will boil and vaporize. Accordingly, it is not possible to obtain a high quality thin metal wire having an amorphous structure or a nonequilibrium crystalline structure. The liquid coolant layer should have a thickness of at least 1 cm, preferably 2 to 10 cm, more preferably 3 to 5 cm, and a length of at least 5 cm, preferably 5 to 100 cm, more preferably 10 to 60 cm. There are various methods of forming the strip of liquid coolant. For example, it may be accomplished by projecting a liquid coolant under pressure through a projection nozzle of a prescribed shape (hereinafter, referred to as "coolant jet nozzle"). (Hereinafter, the flow of liquid coolant projected through the coolant jet nozzle will be referred to as "liquid coolant jet flow".)

The shape, size, etc., of the coolant jet nozzle may well be determined with consideration to factors such as the stability of the strip of liquid coolant, the productivity of the operation, the economy of the production, the conditions of final transaction and the shape of the end-use product. When a multiplicity of thin metal wires are to be simultaneously solidified by cooling and then continuously wound up or when such multiplicity of thin metal wires are to be cooled and solidified, and immediately processed to produce mats of nonwoven fabrics, the coolant jet nozzle to be used preferably has a rectangular aperture slightly wider than the width of the spinning nozzle used for extruding molten metal or the width of the mat of nonwoven fabric to be produced.

The liquid coolant to be used in this invention may be a pure liquid, solution, emulsion, etc. The liquid coolant preferably reacts with the extruded flow of molten metal and gives a stable surface to the flow of molten metal or is totally incapable of chemically reacting with the flow of molten metal discharged. Particularly to ensure that the flow of molten metal, when quenched in the liquid coolant, will transform itself into a thin metal wire of high quality having a circular cross section, an amorphous structure or a nonequilibrium crystalline structure, the liquid coolant selected is preferably capable of producing a proper cooling rate and the strip of this liquid coolant is required to remain stable enough to withstand disturbing influences. In order to obtain a particularly favorable cooling rate, it is desirable to use water or an aqueous electrolyte solution containing a dissolved metal salt either at room temperature or below room temperature. Generally, the process in which the flow of molten metal is quenched by contact with the liquid coolant consists of three separate stages. In the first stage, the film of coolant vapor completely envelopes the molten metal. Since the cooling is effected by the radiation of heat through the film of coolant vapor, it proceeds at a relatively low speed. In the second stage, the film of coolant vapor breaks and vigorous boiling occurs continuously. Since the heat is liberated preponderantly in the form of heat of vaporization, the highest cooling rate is obtained. In the third stage, since the boiling stops and the cooling is effected by conduction and convection of heat, the cooling rate falls again. The cooling may be expedited most effectively, therefore, by (A) selecting a coolant which is capable of minimizing the duration of the first stage and commencing the second stage as soon as possible and (b) causing the coolant or the molten metal to be moved quickly by an artificial measure thereby breaking the film of coolant vapor in the first stage and advancing the cooling of the second stage as much as possible. For example, the fact that the cooling rate with violently stirred water is more than four times that with still water ought to imply the desirability of the measure mentioned above.

In short, in order to increase the cooling rate, it is essential that the liquid coolant have a high boiling point and a large latent heat of vaporization and the strip of liquid coolant should quickly liberate vapor or bubbles and have high flowability. The cost of the coolant and its ability to withstand degradation are important factors. In order to artificially expedite the breakage of the film of vapor in the first stage, advance the cooling of the second stage, and elevate the cooling rate as a whole, it is desirable to adopt a coolant having a large specific heat, e.g., water, aqueous solution, etc., increase the speed ($V_W$) of the strip of coolant, increase the speed ($V_J$) of the flow of molten metal extruded through the spinning nozzle, increase the angle ($\theta$) formed between the flow of molten metal and the strip of coolant, and decrease the distance between the spinning nozzle and the strip of coolant. Although the increased speed of the strip of coolant is desirable for the purpose of enhancing the capacity for cooling rate, it is conversely undesirable for the purpose of producing a uniform, continuous thin metal wire particularly by using a coolant jet flow as the strip of coolant because it tends to increase the Reynolds number ($Re=(D\bar{U}\rho/\mu$; D approximating the diameter of jet nozzle, $\bar{U}$ approximating the average flow speed of jet flow, $\rho$ approximating the density of coolant, and $\mu$ denoting the viscosity of coolant) and go to disturb the jet flow. To stabilize the jet flow, it is desirable to increase the viscosity of the coolant in use and decrease the Reynolds number thereof as much as possible, although the shape, fabrication accuracy, etc., of the jet nozzle used for projecting the coolant are also important factors. If the Reynolds number is increased, the strip of coolant is disturbed.

Figure 2:
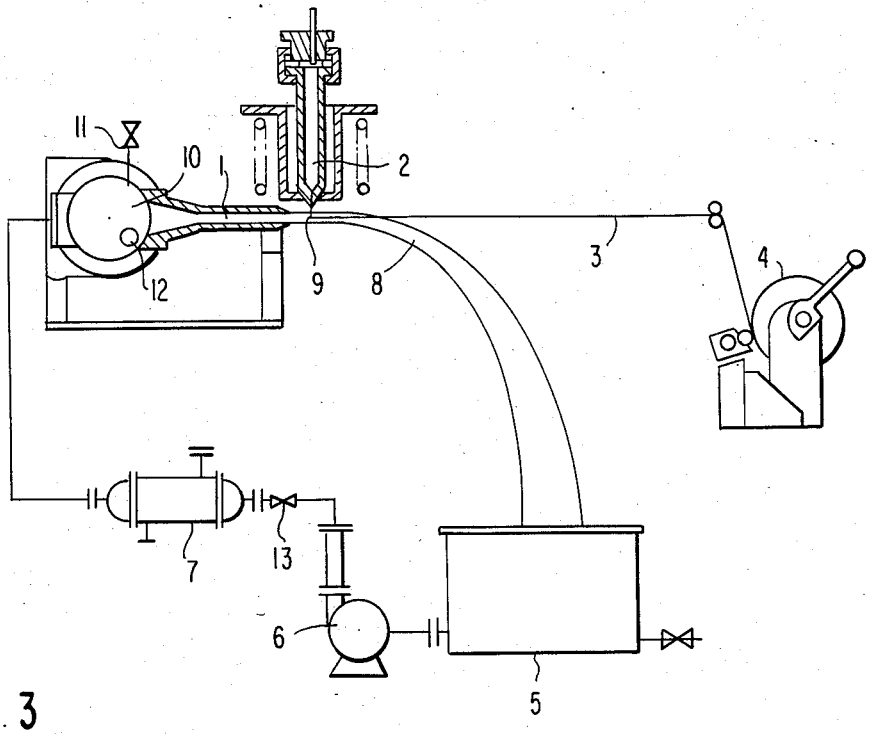
FIG. 2 is a schematic diagram illustrating the devices utilized in carrying out the method of the present invention for producing a thin metal wire.

The present invention will now be described in detail below with reference to the accompanying drawings. FIGS. 1 and 2 represent a device embodying this invention. The device comprises a coolant jet nozzle 1, an extruder 2 for molten metal, a winding frame 4, a coolant receptacle 5, a pressure pump 6 for coolant, and a cooling device 7.

The liquid coolant from the liquid coolant receptacle 5 is pressurized to a stated pressure by the pressure pump 6 and cooled to a stated temperature by the cooling device 7 and then projected through the coolant jet nozzle 1 at a fixed speed which is determined by the magnitude of the pressure applied to the liquid coolant. The nozzle of the extruder 2 for molten metal is disposed at a fixed angle close to the upper surface of the liquid coolant jet flow 8. Under the pressure of an inert gas, for example, the molten metal is projected through the spinning nozzle into the liquid coolant jet flow 8. The projected flow of molten metal 9 is incorporated in the liquid coolant jet flow 8, there to be quenched and solidified into a thin metal wire having a circular cross section.

The cooling rate in this reaches as high as $10^4$ to $10^6$ °C./sec. Thus, a thin metal wire having an amorphous structure or nonequilibrium crystalline structure can be obtained up to a diameter of about 0.3 mm even if water is used as the liquid coolant at room temperature by adopting an alloy excelling in ability to form an amorphous structure or nonequilibrium crystalline structure, such as, for example, Fe-Si-B, Fe-Cr-Si-B, Fe-Me(Ni, Co, Ta, Nb, W)-Si-B, Fe-P-C, Fe-Cr-P-C, Fe-Me(Mo, V, W)-P-C, Co-Si-B, CoMe(Fe, Ni, Nb, Ta, Cr)-Si-B, Fe-P-B, Fe-Cr-P-B, Fe-Cr-C, Fe-Mn-Al-C, Fe-Ni-Al-C, Mn-Al-C, Fe-Al-C, or (Fe, Ni)-Cr-Al alloy, increasing the speed ($V_W$) of the liquid coolant jet flow, and increasing the angle ($\theta$) formed between the liquid coolant jet flow 8 and the projected flow of molten metal 9. The thin metal wire 3 thus produced is forwarded as drawn to a suitable tension by the liquid coolant jet flow 8 and cooled to a temperature near room temperature, i.e., the temperature at which the thin metal wire can be safely wound up. The thin metal wire 3 which has been cooled and solidified as described above is separated from the liquid coolant flow by the gravitational attraction working on the liquid coolant flow, and then taken up continuously as a finished product on the winding frame 4.

The conditions under which the production of the thin metal wire is effected by use of the device described above will be explained in detail. The speed ($V_J$) of the molten metal flow 9 emanating from the nozzle of the molten metal extruder 2 can be freely fixed by the magnitude of the inert gas pressure in the extruder 2. The speed ($V_W$) of the liquid coolant jet flow 8 emanating from the coolant jet nozzle 1 can be freely set by adjusting the magnitude of the coolant pressure created by the coolant pressure pump 6. If the value of $V_W$ is smaller than that of $V_J$, the thin metal wire produced is warped and has an uneven diameter. If this condition exists it is not possible to produce a uniform, straight thin metal wire. In order to obtain a straight thin metal wire of uniform diameter it is essential that the aforementioned speeds be selected so as to satisfy the relationship of $V_W > V_J$. Particularly, in order to continuously obtain a straight thin metal wire of uniform diameter, the diameters preferably satisfy the relationship of $V_W = (1.05 \sim 1.35)V_J$. The optimum relationship between $V_W$ and $V_J$ varies depending upon the kind of an alloy used, melting temperature and orifice diameter of spinning nozzle. That is, for example, when the orifice diameter of spinning nozzle is small, the relationship of $V_W = (1.05 \sim 1.20)V_J$ is approximately satisfied and when the orifice diameter is as large as 0.2 to 0.3 mm, the relationship between $V_W$ and $V_J$ is adequately approximated by the relationship of $V_W = (1.15 \sim 1.35)\ V_J$. Further, under the condition of $4.0V_J > V_W > 1.35V_J$, it becomes possible to obtain a thin metal wire in the form of short fibers. To obtain a thin metal wire of high quality having an amorphous structure or nonequilibrium crystalline structure by quenching and solidifying the molten metal flow, it is necessary that the two flows satisfy the relationship of the aforementioned formula, the speed ($V_J$) of the liquid coolant jet flow should exceed 200 m/min, and the angle ($\theta$) formed between the molten metal flow and the liquid coolant jet flow should exceed 30°.

Preferred results are obtained when using metals such as an Fe-P-C, Fe-Si-B, or Co-Si-B type amorphous alloy or an Fe-(Mn, Ni)-Al-C, Mn-Al-C, (Fe,Ni)Cr-Al, or Fe(W, Mo, Cr, Ni)-C type nonequilibrium crystalline alloy having superior ability with respect to forming an amorphous structure of nonequilibrium crystalline structure. When using such metals a thin metal wire of particularly high quality having an amorphous structure or nonequilibrium crystalline structure can be obtained when $V_W$ exceeds 400 m/min and $\theta$ exceeds 40°, preferably falling in the range of 50° to 90°. The thin metal wire of an amorphous structure or nonequilibrium crystalline structure which is obtained in this case has a diameter ranging from 0.05 mm to 0.40 mm. The thickness of the layer of liquid coolant jet flow is required to be at least 1.0 cm. If the thickness is less than 1.0 cm, the molten metal flow sinks under the liquid coolant jet flow. Consequently, the molten metal is cooled insufficiently and cannot be readied for the next step of winding. The distance between the leading end of the spinning nozzle and the upper surface of the liquid coolant jet flow preferably does not exceed 10 mm, more preferably 3 mm or less.

The liquid coolant jet flow which constitutes one embodiment of this invention will be described with reference to FIG. 2. In this diagram, 1 denotes a coolant jet nozzle, 2 denotes an extruder for molten metal, 3 denotes a thin metal wire, 4 denotes a winding frame, 5 denotes a coolant receptacle, 6 denotes a pressure pump for the coolant, 7 denotes a cooling device, 8 denotes a liquid coolant jet flow, 9 denotes a molten metal flow, 10 denotes a pressure head tank for coolant, 11 denotes an air vent, 12 denotes a pressure gauge, and 13 denotes a pressure regulating valve.

The liquid coolant is pressurized by the coolant pressure pump 6 and cooled to a stated temperature by the cooling device 7, and then transferred to the pressure head tank 10. The pressure in the pressure head tank 10 is to be determined solely by the speed ($V_W$) expected of the liquid coolant jet flow 8. It is adjusted by the pressure gauge 12 and the pressure regulating valve 13. The pressurized coolant is projected at the stated speed ($V_W$), width, and thickness through the coolant jet nozzle 1. The nozzle 1 has a gradually converging, smoothly finished inner surface. The coolant has its flow regulated by the coolant jet nozzle 1 and, while maintaining the cross-sectional shape acquired at the outlet of the nozzle, quenches and solidifies the molten metal flow 9 emanating from the molten metal extruder 2, and thereafter advances while retaining the thin metal wire 3 in steady flow, and flows into the coolant receptacle 5.

The thin metal wire 3 is continuously taken up on the winding frame 4 (with the drive mechanism and the traverse mechanism omitted from the diagram). The angle formed between the molten metal extruder 2 and the liquid coolant jet flow 8 can be freely set by suitably changing the positions of the coolant jet nozzle 1 and the molten metal extruder 2. The diameter of the spinning nozzle in the molten metal extruder 2 preferably approximates the diameter desired for the thin metal wire. In general, the diameter is not more than 0.5 mm. For the purpose of obtaining a thin metal wire of high quality having an amorphous structure or nonequilibrium crystalline structure, the diameter is preferably not more than 0.3 mm, more preferably 0.2 mm or less.

The kind of the liquid coolant and the temperature thereof are selected in relation to the thermal capacity of the molten metal flow. The thermal capacity of the molten metal flow increases in direct proportion to the temperature, specific heat, latent heat, and cross-sectional area of the molten metal flow. When the thermal capacity of the molten metal flow is large, therefore, it is desirable to lower the temperature of the liquid coolant and increase the specific heat, density, heat of vaporization, and thermal conductivity of the liquid coolant. The liquid coolant should be nonflammable and inexpensive while being viscous enough to minimize possible rupture of the molten metal flow within the coolant jet flow. Especially when the coolant jet forms a turbulent and instable flow, it is desirable to add to the coolant a small amount of a tackifier such as polyethylene glycol or cellulose ether to lower the Reynolds number of the coolant and allow the coolant to form a stable flow (laminar flow). As the coolant, water is a good choice. Generally, the quality of the thin metal wire having an amorphous structure or non-equilibrium crystalline structure improves in proportion to increases in cooling rate. Therefore, it is desirable to adopt as the coolant an aqueous solution of electrolyte cooled to below room temperature. Typical examples of the aqueous solution of electrolyte include an aqueous solution containing 10 to 25% by weight of sodium chloride, an aqueous solution containing 5 to 15% by weight of sodium hydroxide, an aqueous solution containing 5 to 25% by weight of magnesium chloride or lithium chloride, or an aqueous solution containing 50% by weight of zinc chloride.

Figure 3:
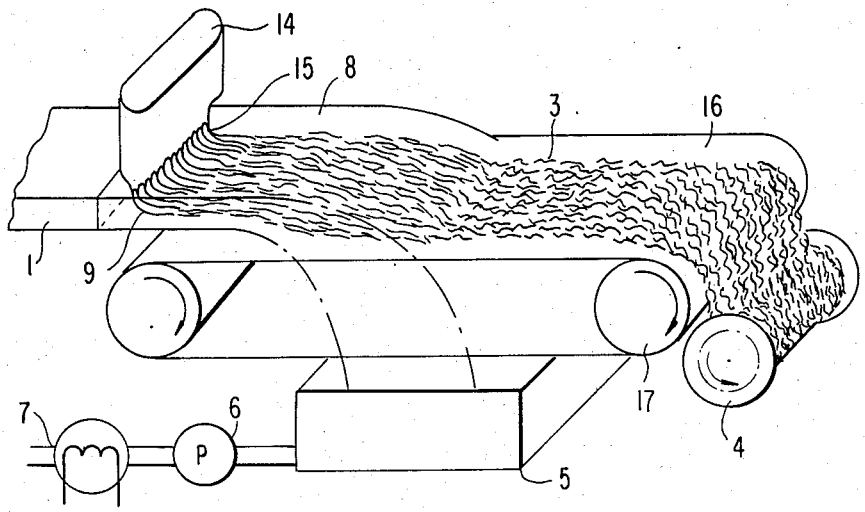
FIG. 3 is a schematic diagram of a mechanism utilized in carrying out the method of the present invention utilized in order to produce a matlike nonwoven fabric.

FIG. 3 is a schematic diagram illustrating another embodiment of a device of the present invention for economically producing a matlike nonwoven fabric of thin metal wires directly from molten metal. This device comprises a melting unit 14 containing a multiplicity of spinning nozzles 15, a rectangular coolant jet nozzle 1, a conveyor filter 16 serving to separate quenched and solidified thin metal wires 3 from a liquid coolant jet flow 8 and transfer them collectively forward, and a drive roll 17 serving to drive the conveyor filter 16.

The length, shape, etc., of the thin metal wires which make up the matlike nonwoven fabric can be adjusted by suitably regulating the speed ($V_J$) of the molten metal flow, the speed ($V_W$) of the liquid coolant jet flow, and the amount of disturbance caused in the liquid coolant jet flow. To obtain a mat formed of crimped short fibers, it is necessary that the two flows should satisfy the relationship of the formula $V_W > 1.35V_J$ and the liquid coolant jet flow should be disturbed.

The term "circular cross-section" as used herein means that the ratio of the minor axis diameter (Rmin) to major axis diameter (Rmax) [i.e., (Rmin/Rmax)] of the same cross-section is 0.6 or more.

The present invention will now be described more specifically below with reference to working examples. However, the present invention is not limited to these examples.

EXAMPLE 1

In a device arranged as shown in FIG. 2 and provided with a coolant jet nozzle 1 measuring 4 cm in width and 3 cm in depth, an alloy consisting of 72.5 atomic % of Fe, 5.0 atomic % of Cr, 12.5 atomic % of P, and 10 atomic % of C, possessing an ability to form an amorphous structure, and excelling in corrosion-proofness was dissolved at 1,200° C. under a blanket of argon. The molten alloy was projected under argon pressure of 3.5 kg/cm$^2$ through a spinning nozzle 0.15 mm in diameter, at an angle of 70°, into a coolant jet flow ($V_W$) formed of an aqueous 20% sodium chloride solution at −15° C. and moved at a regulated speed of 450 m/min, there to be quenched and solidified, and then continuously taken up on a winding frame 4. The length of the strip of liquid coolant was 50 cm. The distance between the spinning nozzle and the surface of the liquid coolant jet flow was kept at 1 mm and the spinning nozzle was held as close to the coolant jet nozzle side as possible. At this time, the speed ($V_J$) of the molten metal flow emanating through the spinning nozzle was 410 m/min. The speed was determined by measuring the discharge volume $Q_1$ (g/min) of the molten metal per unit time and finding the value of the term $V_J$ in the formula, $Q_1 = \pi(D_0/2)^2 \cdot V_J \cdot \rho_1$; where $D_0$ denotes the diameter of the spinning nozzle orifice (in cm) and $\rho_1$ denotes the density of alloy.

The thin metal wire thus produced had an average diameter of 0.135 mm and a differential from roundness of 0.90. Thus, the shape of its cross section was very near a true circle. The unevenness of thickness in the direction of its length was 7.0%, the tensile strength at fracture 295 kg/mm$^2$, and the elongation at fracture 2.5%, indicating that the continuous thin metal wire produced was a good quality.

When the metal filament was tested for crystallinity by X-ray diffraction using FeK$\alpha$ irradiation, there was observed a wide diffraction peak characteristic of an amorphous structure.

The unevenness of thickness in the direction of length was determined by measuring diameters at 10 randomly selected points on a 10 m sample wire, finding differences between maximum and minimum diameters, dividing the average difference by the average diameter, and multiplying the resultant quotient by 100.

EXAMPLE 2

In the same device using a coolant jet nozzle 4 cm in diameter, an alloy consisting of 75 atomic % of Fe, 10 atomic % of Si, and 15 atomic % of B was dissolved at 1,250° C. under a blanket of argon. The molten metal was projected under argon gas pressure of 5.5 kg/cm$^2$ through the spinning nozzle 0.20 mm in orifice diameter, at an angle of 60°, into a coolant jet flow formed of water incorporating 0.02% of a water-soluble cellulose ether (sodium carboxymethyl cellulose) as a tackifier to increase the viscosity to 10 centipoises and moved at a regulated flow speed ($V_W$) of 650 m/min at 4° C., there to be quenched and solidified, and thereafter taken up continuously on a winding frame 4. The length of the strip of liquid coolant was 60 cm. The distance between the spinning nozzle and the liquid coolant jet flow was kept at 2 mm. The speed ($V_J$) of the molten metal flow emanating from the spinning nozzle was 540 m/min.

The thin metal wire thus obtained had an average diameter of 0.170 mm and a differential from roundness of 0.92. Thus, the shape of its cross section was very near a true circle. The unevenness of thickness in the direction of length was 5.0%. The continuous thin metal wire, therefore, proved to possess high quality. It was also a high tension and high toughness metal wire, showing a tensile strength of 360 kg/mm$^2$ at fracture and an elongation of 3.5% at fracture.

When this thin metal wire was further drawn with a diamond die in silicone oil at 200° C. to its reduced diameter of 0.140 mm, there was obtained a thin amorphous metal wire of high uniform appearance, indicating 390 kg/mm$^2$ of tensile strength at fracture and 4.8% of elongation at fracture.

EXAMPLE 3

In the same device as used in Example 1, an alloy consisting of 45 atomic % of Fe, 38 atomic % of Mn, 10 atomic % of Al, and 7 atomic % of C and having an ability to form a nonequilibrium crystalline structure was dissolved at 1,400° C. under a blanket of argon gas. The molten metal was projected under argon gas pressure of 4.0 kg/cm$^2$ through the spinning nozzle 0.20 mm in orifice diameter, at an angle of 80°, into a coolant jet flow formed of an aqueous 10% by weight magnesium chloride solution at −20° C. and moved at a regulated speed of 550 m/min ($V_W$), there to be quenched and solidified, and thereafter taken up. The length of the strip of liquid coolant was 55 cm. The distance between the spinning nozzle and the surface of the liquid coolant jet flow was kept at 1.5 mm. The speed of the molten metal flow ($V_J$) projected through the spinning nozzle was 460 m/min.

As a result a very tough thin metal wire was obtained having an average diameter of 0.170 mm, a tensile strength of 90 kg/mm$^2$, an elongation of 30%, a differential from roundness of 0.88, and an unevenness of thickness of 6.0%. When this thin metal wire was cold drawn at room temperature through a diamond die to a reduced thickness of 0.080 mm, there was obtained a high strength extremely fine metal wire having 250 kg/mm$^2$ of tensile strength at fracture and 1.5% of elongation at fracture.

This thin metal wire was tested for crystallinity by X-ray diffraction using FeK$\alpha$ irradiation. The particle diameter of the crystals was determined by observation with an optical microscope. It was found to have a tough nonequilibrium phase of $Ni_3Al$ form made up of crystals having a particle diameter of not more than about 1.5 $\mu$m.

EXAMPLE 4

In the same device as used in Example 2, an alloy consisting of 74.5 atomic % of Mn, 20.5 atomic % of Al, and 5 atomic % of C and having an ability to form a nonequilibrium crystalline structure was dissolved at 1,350° C. under a blanket of argon gas. The molten metal was projected under argon gas pressure of 4.0 kg/cm$^2$ through a spinning nozzle 0.15 mm in orifice diameter, at an angle of 70°, into a coolant jet flow of water at 4° C. moved at a regulated speed of 500 m/min ($V_W$), there to be quenched and solidified. The length of the strip of liquid coolant was 55 cm. The distance between the spinning nozzle and the surface of the liquid coolant jet flow was kept at 1 mm. The speed of the molten metal flow projected through the spinning nozzle ($V_J$) was 450 m/min.

Consequently, there was obtained a very tough thin metal wire of nonequilibrium $\gamma$ phase (face centered cubic lattice) having an average diameter of 0.135 mm, a tensile strength at fracture of 100 kg/mm$^2$, elongation at fracture of 18%, and a differential from roundness of 0.85.

EXAMPLE 5

In the same device as used in Example 1, an alloy consisting of 80 atomic % of Al and 20 atomic % of Cu was dissolved at 650° C. under a blanket of argon gas. The molten metal was projected under argon gas pressure of 2.0 kg/mm$^2$ through a spinning nozzle 0.20 mm in orifice diameter, at an angle of 35°, into a coolant jet flow formed of an aqueous 10% by weight magnesium chloride solution at −20° C. and moved at a regulated speed of 300 m/min ($V_W$), there to be quenched and solidified, and thereafter taken up on a winding frame. The length of the strip of liquid coolant was 40 cm. The distance between the spinning nozzle and the surface of the liquid coolant jet flow was kept at 1.5 mm. The speed of the molten metal flow projected through the spinning nozzle ($V_J$) was 285 m/min.

As a result, there was obtained a microcrystalline metal filament having an average diameter of 0.190 mm, a tensile strength of 55 kg/mm$^2$, an elongation of 3.0%, a differential from roundness of 96% and an unevenness of thickness of 4.0%.

EXAMPLE 6

A device arranged as illustrated in FIG. 3 and provided with a rectangular coolant jet nozzle 1 measuring 50 cm in width and 5 cm in depth was used for the purpose of producing a matlike nonwoven fabric formed of thin nonequilibrium metal wires similar to short fibers directly from molten metal. In the device, an alloy consisting of 70 atomic % of Fe, 8 atomic % of Cr, 8 atomic % of Si, and 14 atomic % of B and having high thermal resistance, strength, and ability to resist corrosion was dissolved at 1,340° C. under a blanket of argon gas. The molten metal was projected under argon gas pressure of 4.5 kg/cm$^2$ through spinning nozzles 15 (80 spinning nozzles 0.13 mm in orifice diameter, spaced at intervals of 5 mm) disposed in a straight row, at an angle of 90°, into a liquid coolant jet flow 8 adjusted at 4° C. and at a speed of 800 m/min ($V_W$), there to be quenched and solidified. Thereafter, the solidified metal flows were separated from the liquid coolant jet flow on a conveyor filter 16 (800-mesh metal gauze) travelling at a speed of 100 m/min, collectively forwarded, and continuously taken up on winding bobbins 4. The length of the strip of liquid coolant was 80 cm. The distance between the spinning nozzles 15 and the surface of the liquid coolant jet flow was kept at 2 mm. The spinning nozzles were held as close toward the coolant jet nozzle 1 side as possible. The speed ($V_J$) of the molten metal flow 9 projected through the spinning nozzles 15 was 540 m/min.

The matlike nonwoven fabric thus obtained was formed of thin amorphous metal wires resembling short fibers and having an average diameter of 0.11 mm, a differential from roundness of 0.85 and length of about 3 to 10 cm.

COMPARATIVE EXAMPLE 1

A thin metal wire having an average diameter of 0.135 mm was obtained by following the procedure of Example 1, except that the speed of the liquid coolant jet flow ($V_W$) was changed to 180 m/min and the speed of the molten metal flow projected through the spinning nozzle to 160 m/min, respectively. The length of the strip of liquid coolant was 30 cm.

This thin metal wire was so brittle that it could not be bent by 180° and folded completely over itself. It lacked strength and toughness peculiar to an amorphous material.

When this thin metal wire was tested for crystallinity by X-ray diffraction, there was observed a strong diffraction peak peculiar to a crystalline material. Thus, it had no amorphous structure.

COMPARATIVE EXAMPLE 2

A thin metal wire having an average diameter of 0.135 mm was obtained by following the procedure of Example 1, except that the angle ($\theta$) formed between the coolant jet flow and the molten metal flow projected through the spinning nozzle was changed to 20°. The length of the strip of liquid coolant was 50 cm.

This thin metal wire was too brittle to serve any useful purpose, similarly to the wire of Comparative Example 1.

When this thin metal wire was tested for crystallinity by X-ray diffraction, there was observed a strong diffraction peak peculiar to a crystalline material. Thus, it had no amorphous structure.

COMPARATIVE EXAMPLE 3

A thin metal wire was obtained by following the procedure of Example 3, except that the speed of the liquid coolant jet flow ($V_W$) was changed to 400 m/min (thus, $V_W < V_J$). It had a large unevenness of thickness (containing bulges more than twice as large in diameter at short intervals, implying that the unevenness of thickness exceeded 100%) and contained numerous sharp bends. Upon pulling the material, it readily broke along one of the bulges. The material was not well suited for actual use.

The broken bulge (about 300 μm in diameter) of the wire was tested for texture by X-ray diffraction and with an electron microscope. It was found to be a mixture of ferrite, austenite, cementite (M3C) carbide, and FeAl compound and was found to contain substantially no $Ni_3Al$ type nonequilibrium single phase.

While the invention has been described in detail and with reference to specific embodiments thereof, it will be apparent to one skilled in the art that various changes and modifications can be made therein without departing from the spirit and scope thereof.

What is claimed is:

1. A method of producing a thin metal wire of a structure selected from the group consisting of an amorphous structure, a non-equilibrium crystalline structure, and a microfine crystalline structure comprising the steps of projecting a molten flow of a metal selected from the group consisting of alloys capable of forming amorphous structures, alloys capable of forming non-equilibrium crystalline structures, and alloys capable of forming microfine crystalline structures into a liquid coolant jet flow in motion at a rate of at least 200 m/min under conditions satisfying the following formulae (I) and (II) and cooling and solidifying said molten flow of metal:

$$V_W > V_J \quad \text{(I)}$$

$$\theta \geqq 30 \quad \text{(II)}$$

wherein $V_W$ is the rate of motion (m/min) of the flow of liquid coolant, $V_J$ is the rate of molten flow (m/min) of the metal projected through a spinning nozzle, and $\theta$ is the angle (degree) formed between the flow of liquid coolant and the molten flow of metal projected through the spinning nozzle.

2. A method of producing a thin metal wire as claimed in claim 1, wherein the jet flow of liquid coolant has a thickness of 1 cm or more and a length of 5 cm or more.

3. A method of producing a thin metal wire as claimed in claim 1, wherein the metal is selected from the group consisting of Fe-Si-B, Fe-Cr-Si-B, Fe-Me(Ni, Co, Ta, Nb, W)-Si-B, Fe-P-C, Fe-Cr-P-C, Fe-Me(Mo, V, W)-P-C, Co-Si-B, Co-Me(Fe, Ni, Nb, Ta, Cr)-Si-B, Fe-P-B, Fe-Cr-P-B, Fe-Cr-C, Fe-Mn-Al-C, Fe-Ni-Al-C, Mn-Al-C, Fe-Al-C, and (Fe, Ni)-Cr-Al alloy.

4. A method for producing a thin metal wire as claimed in claim 1, wherein the speed of the jet flow of liquid coolant and the speed of the extruded molten metal are such that they are within the relationship of the formula:

$$V_W = (1.05 \sim 1.35) V_J.$$

5. A method for producing a thin metal wire as claimed in claim 1, wherein $V_W$ is greater than 400 m/min.

6. A method for producing a thin metal wire as claimed in claim 1, wherein $\theta$ is greater than 40°.

7. A method of producing a thin metal wire as claimed in claim 6, wherein $\theta$ is within the range of 50° to 90°.

8. A method of producing a thin metal wire as claimed in claim 1, wherein the distance from the leading end of the spinning nozzle to the upper surface of the coolant flow is 10 mm or less.

9. A method of producing a thin metal wire as claimed in claim 8, wherein the distance from the spinning nozzle to the upper surface of the liquid coolant flow is 3 mm or less.

10. A method of producing a thin metal wire as claimed in claim 1, wherein the nozzle has an opening having a diameter of 0.5 mm or less.

11. A method of producing a thin metal wire as claimed in claim 10, wherein the diameter of the opening is 0.3 mm or less.

12. A method of producing a thin metal wire as claimed in claim 1, wherein the liquid coolant jet flow is comprised of a solution selected from the group consisting of an aqueous solution of electrolyte containing 10 to 25% by weight of sodium chloride, an aqueous solution of electrolyte containing 5 to 15% by weight of sodium hydroxide, an aqueous solution of electrolyte containing 5 to 25% by weight of magnesium chloride or lithium chloride and a aqueous solution of electrolyte containing 50% by weight of zinc chloride.

* * * * *